United States Patent [19]

Allaire

[11] Patent Number: 4,802,779

[45] Date of Patent: Feb. 7, 1989

[54] KEYBOARD

[75] Inventor: Jean-Luc Allaire, Guichainville, France

[73] Assignee: U.S. Philips Corporation, New York, N.Y.

[21] Appl. No.: 118,383

[22] Filed: Nov. 6, 1987

[30] Foreign Application Priority Data

Nov. 14, 1986 [FR] France ..... 86 15853

[51] Int. Cl.[4] ..... B41J 5/16

[52] U.S. Cl. ..... 400/496; 400/490

[58] Field of Search ..... 400/495, 495.1, 496, 400/490, 491, 491.1, 491.2, 491.3, 694, 481

[56] References Cited

U.S. PATENT DOCUMENTS

| | | | |
|---|---|---|---|
| 4,195,939 | 4/1980 | Denby | 400/427 |
| 4,408,914 | 10/1983 | Ciesiel et al. | 400/208 |
| 4,412,754 | 11/1983 | Sparks | 400/496 |
| 4,661,004 | 4/1987 | Applegate et al. | 400/208 |

*Primary Examiner*—Edgar S. Burr

*Assistant Examiner*—Kimberly L. Asher

[57] ABSTRACT

Keyboard comprising a handle (8,9) intended to prevent an elongate key (4) from being depressed obliquely. In order to simplify the operation of assembling/disassembling the key, the latter comprises an inclined surface (2) and the handle is fixed to the chassis (13) by means of a hook (1) of high elasticity, which permits the handle to be positioned in a slot (3) of the key when the latter is depressed.

5 Claims, 1 Drawing Sheet

FIG.1
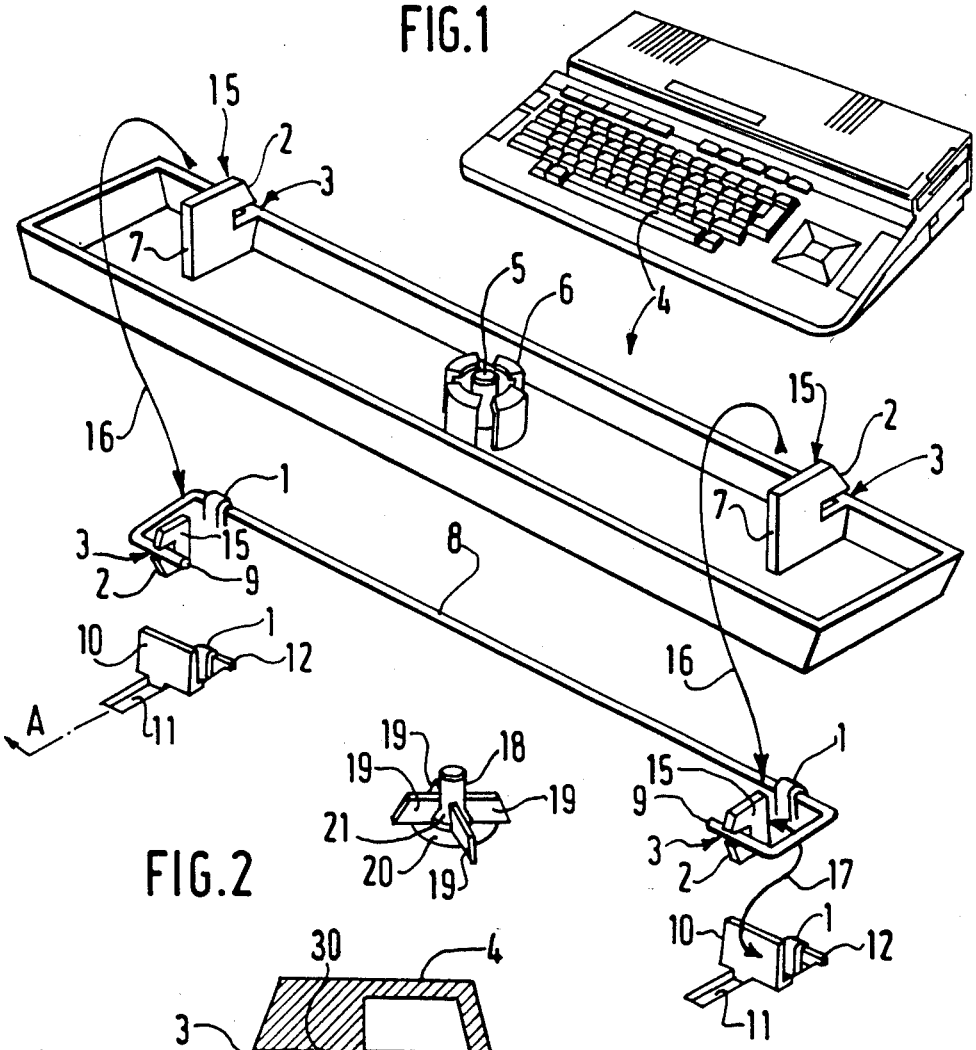
FIG.2
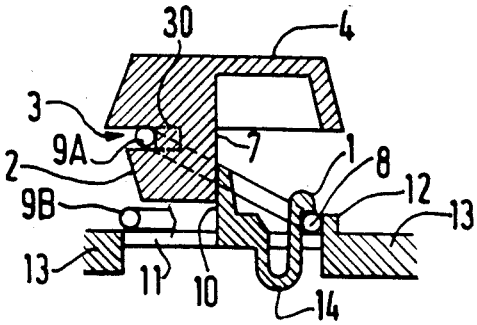
FIG.3

KEYBOARD

The invention relates to a keyboard comprising a chassis provided with an elongate key which is slidable along guide means of said chassis. A handle intended to prevent the key from being depressed obliquely also is provided. The handle is pivotable about an axis perpendicular to the sliding direction of the key. It comprises at least two pins, each of the pins is slidably fitted in a slot of the key which is perpendicular to the sliding direction. The chassis (13) is provided with elastic connection means (1, 12) for mounting the handle (8). Each slot (3) is open at one end in order to permit the entrance of the respective pin (9).

Keyboards according to the invention are used, for example, in data processing arrangements, such as minicomputers.

So-called space bars (elongate keys) provided with a handle of the kind mentioned in the opening paragraph are present in commercially available computer keyboards. In a keyboard which is known from European patent application No. 0178452 the pins of the handle are inserted in guide means which are slidably fitted in the elongate key. Mounting of such a handle and key is relatively complicated and not adapted for automation. In order to mechanize this mounting operation, a complex system would be necessary to maintain and to position all the necessary components together.

The invention has for its object to provide a keyboard, in which the operations of assembling and disassembling are greatly facilitated. In the keyboard according to the invention, the handle can be positioned beforehand on the chassis and the mounting operation is completed by adding the bare key, which can be positioned by depressing it by force. The disassembling operation is also facilitated because it is sufficient to pull the key with a sufficient amount of force.

For this purpose, a keyboard according to the invention is particularly characterized in that, the key (4) is provided with an inclined surface (2) leading to the opening of the slot in the direction away from the main section of the chassis. Elastic connection means (1, 12) permit the handle (8, 9) to follow the inclined surface (2) and enter the slot (3).

Advantageously, the opening of the slot is turned toward the exterior of the key.

In a particular embodiment, the elastic connection means is formed by at least one elastic hook, whose elasticity allows the introduction of the pins into the slots. This hook comprises advantageously a folded part intended to increase its effective length and hence its elasticity and its resilience.

In an industrial embodiment, the elastic hook is advantageously moulded in one piece with the chassis from plastic material.

In order that the invention may be readily carried out, it will now be described more fully, by way of example, with reference to the accompanying drawings, in which:

FIG. 1 shows a keyboard,

FIG. 2 shows in a perspective view the elements of the long key system separated from each other, FIG. 3 is a sectional view taken on the plane A of FIG. 2 of a mounted assembly.

On the keyboard of FIG. 1 reference numeral 4 denotes the elongate key which functions as a so-called space bar.

In FIG. 2, the just-mentioned key 4 is shown upside down in order to represent parts which are normally situated under the key. The arrows 16 indicate the movement to be performed in order to right the key.

The key is provided with sliding means 5,6, which are known and do not form part of the invention. They comprise a central tube 5 intended to slide in a barrel 18 carried by the chassis and cylinder parts 6 serving to enclose a return spring (not shown) and to fix the key by hooking by means of bolts into a relief 21 provided around the barrel 18. This barrel is held at the centre of an annular hole 20 by four wings 19. The cylinder parts 6 can slide into this annular hole and the wings pass between them. Moreover, the tube 5 bears an electrical contact means (not shown). The handle intended to prevent the key from being depressed obliquely comprises in this case a steel wire, whose diameter is about 1.5 mm, whose part 8 constitutes a pivot shaft and of which each end is folded twice at a right angle to form at each end a pin 9 parallel to the shaft 8, namely in this case horizontal and consequently perpendicular to the sliding direction, which in this case is vertical.

The key 4 comprises at each end a leg 15, in which is provided a slot 3 perpendicular to the sliding direction, in this case horizontal. The slot 3 is open at one end, which in this case is turned towards the exterior of the key. In order to illustrate how the assembling operation is carried out, with the handle 8,9 there is indicated the normal position of the legs 15 (and not the whole key, which would have concealed the device), showing how the pins 9 penetrate into the slots 3.

The pivotable shaft 8 of the handle 8,9 is connected to the chassis by hooks 1, which are indicated diagrammatically at the area of the handle and represented in greater detail hereinafter. The hook 1 is disposed opposite to a relief 12 in order to enclose the shaft 8 of the handle between the hook 1 and the relief 12. Moreover, part 7 of each of the legs 15 bears upon a vertical wall 10, as is indicated by the arrow 17, in order to prevent the key from rotating about a vertical axis, while a rectangular hole 11 permits the legs 15 to be depressed when the key is pushed.

The legs 15 are provided with an inclined surface 2, whose function is understood more clearly due to the sectional view of FIG. 3.

In FIG. 3, the assembly is shown in mounted state in the rest position of the key. The elements already described with reference to FIG. 2 are designated therein by the same reference numerals. The chassis is denoted by reference numeral 13 and the pin 9 is shown in a rest position 9A and in a position 9B, which has two functions. On the one hand, when the key is pushed, the handle 8,9 rotates about its shaft 8 and the pin 3 passes from the position 9A to the position 9B, while the part 7 slides along the vertical wall 10. On the other hand, in order to mount the key on the keyboard during the manufacture, first the handle is taken to the position 9B. The shaft 8 is held between the hook 1 and the relief 12 and the handle bears flatly on the chassis. Therefore, there is no need to provide tools for holding it. When the key is positioned and depressed, the inclined surface 2 is inserted on the righthand side of the pin 9B and according as the key descends, the handle is displaced to the left due to the elasticity of the hook 1, which elasticity is sufficient to permit a displacement of the shaft 8 in the direction which permits the pin 9B of following the inclined surface and of entering the slot 3 at the end of the depression step, it then remains enclosed in this gap.

At the beginning of the depression step, the bolts of the elements 6 of the sliding system of FIG. 2 engage into the relief 21 of the barrel 18 and then prevent the key from ascending above the position shown in FIG. 3. In order to guarantee a sufficient elasticity of the hook 1, the effective length of the latter is increased due to the fact that from its point of connection to the chassis it is first directed downwards and is then folded at 14 so as to be directed upwards thereafter. In the embodiment shown, the chassis 13, the wall 10, the hook 1,14 and the relief 12 are all moulded together from a plastic material, for example a material designated as ABS.

As to the disassembling operation, a measure consists in inserting a tool, which moves the hook 1 to the left, the key being depressed, as a result of which the pin 9B is pushed out of the slot 3, after which the key can merely ascend. Another measure, by which the operation of disassembling is even more easy, consists in providing a slot 3 having a larger depth than is required for the normal displacement of the key, as is indicated in the drawing by dotted lines 30. It is then sufficient to pull the key upwards with a fairly large amount of force to release the snap connection 6,21 of the sliding means, and when the lower side of the part 7 arrives at the level of the upper side of the wall 10, the key can be released to the right.

Of course, other embodiments of the invention are possible. More particularly, the hook may have other shapes; it is especially conceivable to use a kind of latch associated with a spring, such as that of a lock.

The slot 3 may also be turned towards the interior of the key, the hook then being turned in the other direction (that is to say that its elasticity would permit in the case of FIG. 3 of pushing the handle to the right). Nevertheless, this solution is less favourable because a smaller part of the width is then left for the handle unless the latter projects from the exterior of the key, which is not desirable. For small series, a group of elements 1,10,11,12 may be constituted by a small independent piece, which engages the chassis. Instead of using a relief 12 opposite to the hook 1, the latter may also be provided at its end with a kind of gripper enclosing the shaft of the handle.

What is claimed is:

1. A keyboard comprising a chassis with a main section and provided with an elongate key and guide means, said key being slidable along said guide means of said chassis, said keyboard having a handle intended to prevent the key from being depressed obliquely, said handle being pivotable about an axis perpendicular to the sliding direction of said key, said handle being formed of a wire shaft each end of which is folded twice at right angles to form two U-shaped sections each with a pin parallel to the rest of the shaft, said key having two slots perpendicular to said sliding direction, each pin being slidably fitted in an associated slot of said key, said chassis being provided with elastic connection means for mounting said handle, each slot of said key being open at one end in order to permit the entrance of its respective pin, said key being provided with an inclined surface for each slot leading to the opening of its associated slot, each said inclined surface being on the side of said key away from the main section of said chassis, said elastic connection means permitting said pins to follow said inclined surface and to enter each of said slots thereby connecting said key to said chassis, said elastic connection means and said inclined surface forming a releasing means for readily releasing said handle pins from said slots.

2. A keyboard as claimed in claim 1, wherein the opening of each slot (3) is turned towards the exterior of the key.

3. A keyboard as claimed in any one of claims 1 or 2, wherein said elastic connection means is formed by at least one elastic hook (1), whose elasticity allows the introduction of the pins (9) into the slots (3).

4. A keyboard as claimed in claim 3, wherein the hook (1) comprises a folded part (14) intended to increase its effective length.

5. A keyboard as claimed in claim 3, wherein the elastic hook (1,14) is moulded in one piece with the chassis (13) from plastic material.

* * * * *